United States Patent [19]

Reed

[11] 4,170,010

[45] Oct. 2, 1979

[54] INFLATABLE RADIATION ATTENUATOR

[75] Inventor: Robert G. Reed, Tulsa, Okla.

[73] Assignee: Rockwell International Corporation, El Segundo, Calif.

[21] Appl. No.: 711,467

[22] Filed: Mar. 4, 1968

[51] Int. Cl.[2] ..... H01Q 17/00

[52] U.S. Cl. ..... 343/18 A

[58] Field of Search ..... 343/18 A, 18 B; 355/92, 355/73

[56] References Cited

U.S. PATENT DOCUMENTS

| | | | |
|---|---|---|---|
| 2,814,038 | 11/1957 | Miller | 343/18 B |
| 3,001,196 | 9/1961 | McIlroy et al. | 343/18 B |
| 3,165,751 | 1/1965 | Clark | 343/18 B |
| 3,170,471 | 2/1965 | Schnitzer | 343/705 X |

*Primary Examiner*—Malcolm F. Hubler

*Attorney, Agent, or Firm*—Charles T. Silberberg; L. Lee Humphries

[57] ABSTRACT

An arrangement for providing an inflatable cover or structure having radar-energy absorbing characteristics. Thus, a structure may be either formed of, or covered by, this material -- which may be compacted during certain stages of its life, and inflated at other times in order to provide the desired radar-energy absorption.

20 Claims, 9 Drawing Figures

INFLATABLE RADIATION ATTENUATOR

BACKGROUND

It is well known that "radar" is used to detect the presence of various bodies, such as airplanes, ships, vehicles, and the like; this result being an "echo" technique achieved by transmitting a beam of electromagnetic energy, and then picking up its reflection from the foreign body. By noting the direction from which the energy had been reflected, and measuring the time interval between emission of the original radiation and collection of the reflected energy, it is possible to determine the direction and distance (range) of the body; and this gives rise to the acronym "RADAR" (Radio Detection And Ranging). While the term "radar" is actually a technique or an overall system, the term "radar" is widely used in a general sense to designate the emitted and/or reflected energy (as "radar pulse"), the wavelength of the electromagnetic radiation (radar frequency), etc.; and this practice will be followed.

At various times, it is advantageous to prevent bodies from being detected by radar; and to do this, the body must be configurated, treated, coated, etc. to prevent the radar-energy from being reflected; configurations and materials that accomplish this result being known as radar attenuators or radar absorbers.

Many such radar absorbing materials are known; and various mechanical structures have been designed to permit the optimum use of these materials. One such structure—disclosed in U.S. Pat. No. 2,599,944—is known as a "Salisbury Screen"; and its operation may be understood from FIG. 1. In this illustration, assume that radar-energy approaches as indicated by arrow 20; and impinges perpendicularly upon a metallic sheet 22, which reflects the radar-energy. The impinging and reflected radar-energy coact to form a phenomenon known as a "standing wave," which is represented by sinusoidal waveform 24. Waveform 24 indicates the electrical distribution of the standing wave; and shows that it has a first maximum value at one-quarter of a wavelength ($\lambda/4$) from metal sheet 22; that maximum electricl values occur at odd quarter-wavelengths ($\lambda/4$, 3/4, etc.) from reflective plate 22; and that minimum electrical values occur at multiples of half-wavelengths (2/4, $\lambda$, etc.) from metal plate 22.

It is known that if a sheet having suitable electrical resistance is placed parallel to, and one-quarter to the radar wavelength from reflective plate 22,—i.e., at the point of maximum electrical value identified by reference character 26—this resistive sheet will absorb substantially all of the standing-wave electrical energy at that point; so that no portion of the standing wave or reflected radar energy will exist to the left of the resistive sheet positioned at location 26. This means that all of the reflected energy is absorbed; that none of it would reach the radar station that is searching for the radar-reflecting body; and that the body is thus hidden from the radar station. Thus, a Salisbury Screen can be used as a radar-absorbing structure that will prevent the detection of a body by radar.

As pointed out above, the resistive-sheet at location 26 must have specific characteristics; and these characteristics may be understood, in a general way, from the following discussion. As the electromagnetic radar wave is propagated through space, it "sees" a resistance having a value of 377 "ohms per square" (to be discussed later); and it propagates continuously through an environment having this resistance. Any time that the electromagnetic wave "sees" a different resistance, or "discontinuity," a disturbance is produced; this disturbance—depending upon its characteristics—causing the wave to be partially reflected, partially transmitted, and/or partially absorbed.

Referring back to FIG. 1, it will be seen that the impinging radar-energy "sees" a disturbance, namely metal sheet 22, that has a resistance of practically zero; this disturbance resulting in a reflected wave that coacts with the impinging wave to produce standing-wave 24.

As previously discussed, a resistive-sheet positioned one-quarter of a wavelength from metal sheet 22, will absorb energy from the standing wave 24, provided that the resistive-sheet has certain characteristics. One of these characteristics is that it should have a resistance of 377 "ohms per square," this term defining the electrical resistance of a square piece or unit area of material that is carrying electricity from one edge to the opposite edge. It will be realized that as the size of the square increases, its current-carrying width changes; but its current-carrying length changes in the same manner—so that its electrical resistance remains substantially constant, producing a substantially constant value of "ohms per square" that depends primarily on the characteristics of the material. The same relation holds for a square whose size is decreased; i.e., its current-carrying width and length both decrease.

Desired ohms-per-square resistance can be achieved in a number of ways. One simple way is to have a sheet of fabric impregnated with a suitable amount of resistive material, such as carbon. If the sheet has a resistance of 377 ohms per square, it is now called "space cloth."

When this resistive-sheet space-cloth is suitably positioned, the impinging radar does not experience any discontinuity, there is no disturbance, and therefore the sheet does not produce any reflection to be picked up by the radar station. The radar wave is transmitted through the resistive-sheet to the reflective metal-sheet 22, of FIG. 1, from where it is reflected to produce standing wave 24 as discussed above. Since the resistive-sheet is at a point of high electrical value of the standing-wave 24, an electrical current flow is produced in the plane of the sheet; and its electrical resistance quickly absorbs the energy. Thus a Salisbury screen as described above may be used as a radar-absorbing material that minimizes reflections, or as a radiation attenuator that protects bodies behind the screen from exposure to the incoming radiation.

It will be realized that the Salisbury screen discussed above is operative for one particular radar frequency (wavelength); since the resistive-sheet is placed a quater of a wavelength from the metallic reflector. It is known that radar stations frequently use a multiplicity of frequencies; and, to solve this problem, a Salisbury-type screen may be constructed as shown in FIG. 2.

Here it is assumed that the impinging radar-energy includes three different frequencies (three different wavelengths); and therefore three different resistive sheets are used—each positioned one quarter of the respective wavelength (at locations 26*a*, 26*b*, and 26*c*) from a metallic reflecting sheet 22*a*. Therefore, the composite multi-layer Salisbury-type screen of FIG. 2 acts to absorb the energy of the three-different-wavelength radar waves; this being known as a "broad bandwidth" absorber.

Much work has been done on Salisbury-type screens; and it has been found that it is quite difficult to make space-cloths that have a resistance of exactly 377 ohms per square; with the result that there is, in actuality, a limited reflection—and transmission—at each sheet. Moreover, the sheets of FIG. 2 must be properly spaced; and it has been found that the necessary spacing-structure also produces disturbing influences. Therefore, in actuality, the structure as shown in FIG. 2 does not work exactly as theoretically indicated. In addition, it has also been found that the sheets' operation is improved if they are partially "reactive," rather than being purely resistive, and if the various sheets have slightly different construction and resistances. Despite all of the above complexities, it has become possible to produce Salisbury-type screens of the type discussed in FIG. 2 that operate quite satisfactorily; these screens taking the form of flexible blankets, rigid structural material, etc.; their structural, electrical, and functional characteristics, etc., being discussed in U.S. Pat. No. 3,349,397 entitled "Flexible Radiation Attenuator" by J. R. Rosenthal.

Despite the various forms of Salisbury screens available, there is still a need for an inflatable radar-absorbing-material having a structure that is suitable for being inflated under desired conditions. A material of this inflatable type may, for example, be stored in a compacted deflated form until its use is desired; whereupon it can be inflated to quickly assume its design size, shape, and radar-absorbing characteristics. Another use for a device of this sort is a satellite that is launched in a compact form, and then suitably inflated to assume its desired size and shape.

OBJECTS AND DRAWINGS

It is therefore an object of the present invention to provide an improved inflatable radar absorber or attenuator.

The attainment of this object and others will be realized from the following detailed description, taken in conjunction with the drawings of which:

DETAILED DESCRIPTION

Figure 3:
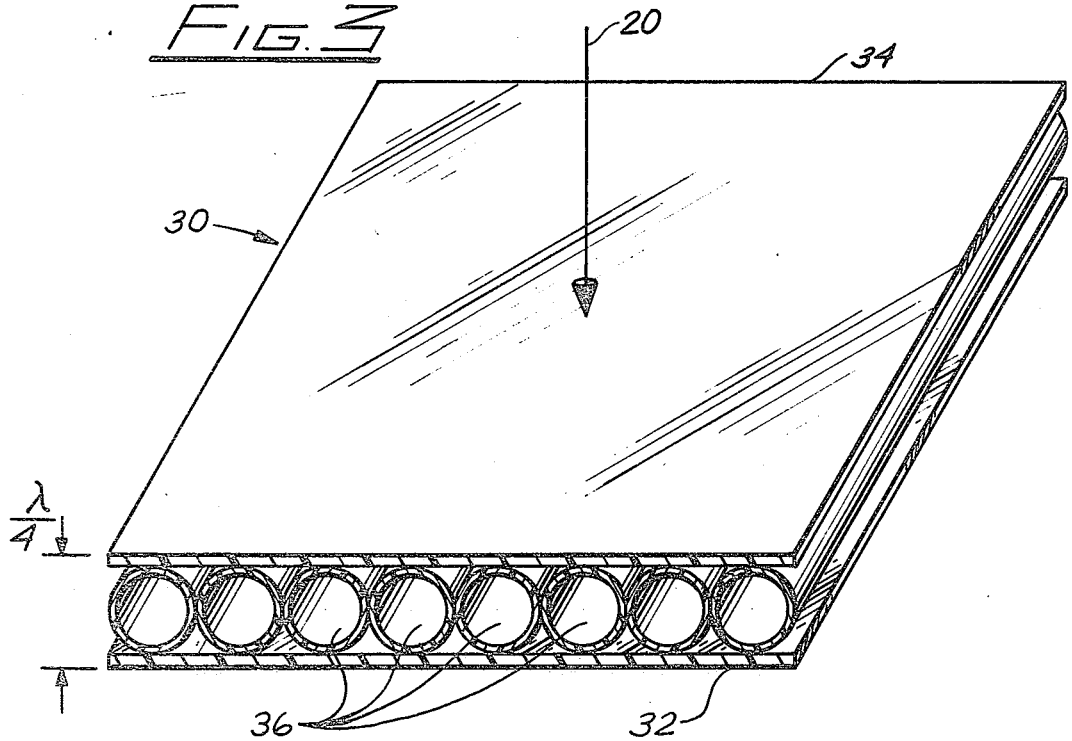
FIG. 3 illustrates one inflatable Salisbury-screen-type radiation absorber.

FIG. 3 shows an inflatable Salisbury-type screen 30 for attenuating or absorbing radar waves approaching in the direction indicated by arrow 20. Reference character 32 indicates a metallic radar-wave reflecting sheet, which may take the form of a metallic foil on a sheet of plastic film.

As discussed above, the impinging radar waves are reflected from sheet 32; and establish a standing-wave pattern. To produce the Salisbury-screen effect, an absorbing sheet 34 is to be positioned a quarter of a wavelength of the impinging radar-wave from reflecting sheet 32; and in FIG. 3 this spacing is achieved by a plurality of inflatable tubes 36 that have their diametrically-opposed areas affixed to sheets 32 and 34 respectively. Tubes 36 may be independent or interconnected; and when these are inflated by any suitable means (not shown) they expand to their design size, and assure that the spacing between reflective sheet 22 and resistive sheet 34 is one quarter of the wavelength of the impinging radar waves.

It will be apparent that in its deflated state the entire structure 30 can be compacted and compressed to a fraction of its expanded size; and that in its inflated form the proper spacing is achieved by the dimensions of the tubes.

Figure 1:
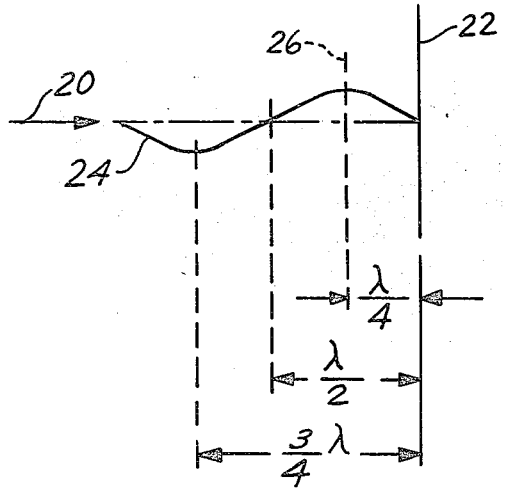
FIGS. 1 and 2 illustrate the basic concept of the Salisbury screen.
Figure 2:
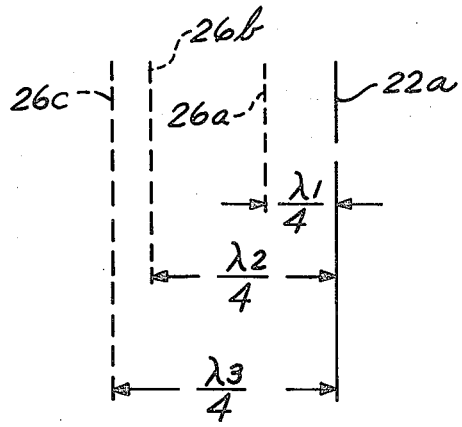

It is also apparent that in order to produce the composite multi-layer configuration indicated by the discussion of FIG. 2, the structure of FIG. 3 would have a plurality of absorbing sheets 34 separated by a plurality of properly-diametered tubes such as 36. Thus, this disclosed structure will produce an inflatable multi-layered Salisbury-type screen for absorbing impinging radar energy.

Figure 4:
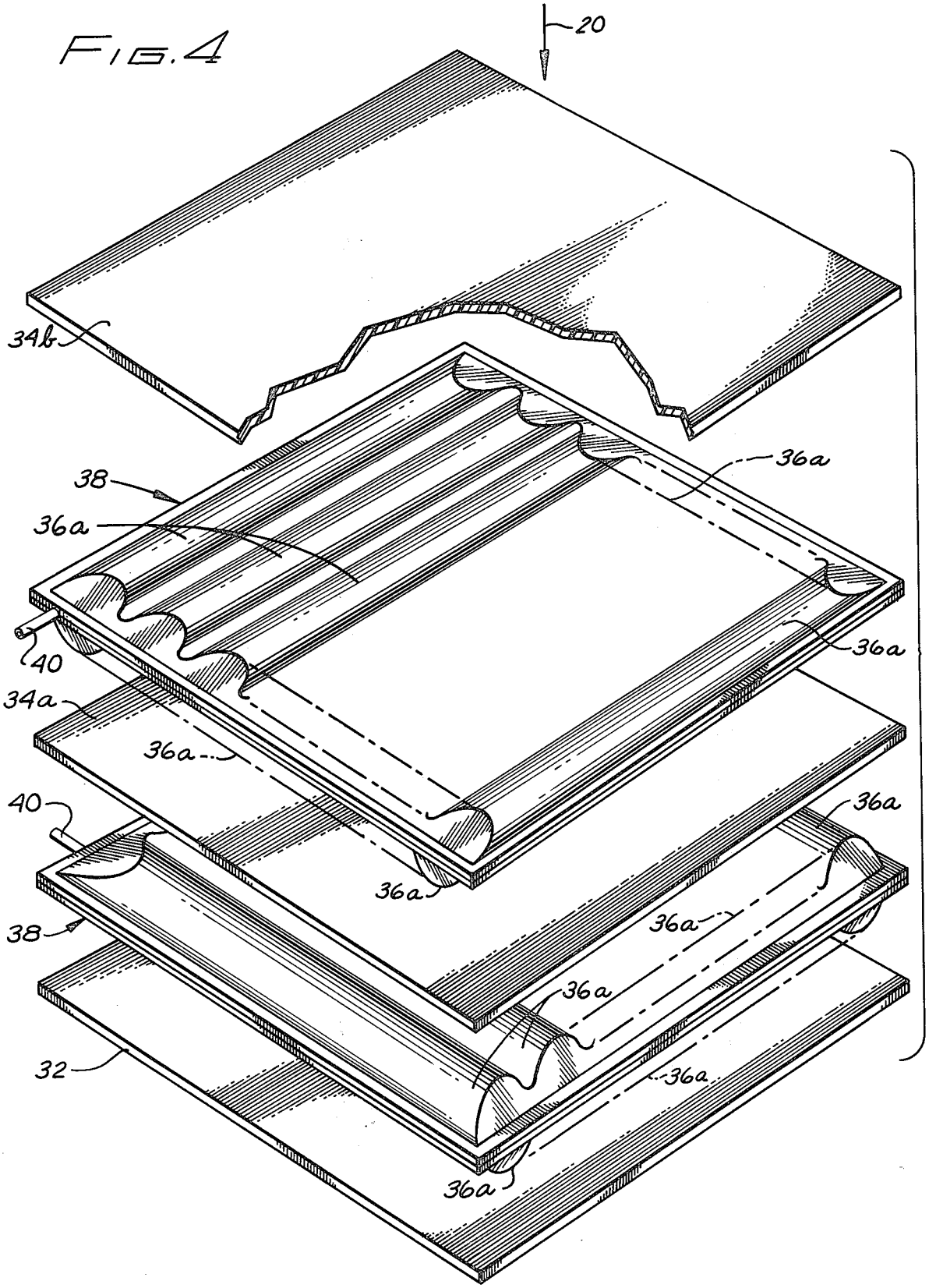
FIG. 4 illustrates another inflatable Salisbury screen radiation absorber.

Under some conditions, it is preferable to use the inflatable absorbing-structure configuration illustrated in FIG. 4. This comprises a reflecting-sheet or ground plane 32 and one or more absorbing sheets 34*a*, 34*b*, etc., in order to form a desired multi-layer broad-band Salisbury-type radar-absorbing screen. In FIG. 4, the separators 38 take the form of a pair of plastic sheets that are bonded at their peripheries and at intermediate portions, to form a plurality of interconnected inflatable tubes 36*a* in fluid communication with each other. Inflating valves 40 admit air to the tubes of the separator sheets, and inflate them to their distended configuration—which is similar to that of an air mattress. The configuration shown in FIG. 4 is illustrated in an exploded form; but in actuality, the various sheets are bonded together at their contact areas; so that the inflated structure produces a Salisbury-type screen having suitably-spaced absorber-sheets 34 for absorbing radar energy.

Here again, it will be seen that when the absorbing-structure is in its deflated state, it will require only a fraction of the room taken by the structure in its inflated state.

As indicated previously, the air-mattress spacing structure that positions the absorber-sheets may appear as a discontinuity to the impinging radar waves; and produce a reflected and/or a refracted radar wave. The support and spacing structure for the absorbing-sheets thus complicate the computations and design of a multi-layer Salisbury-type screen having the desired resistance and spacing characteristics.

In the discussed structures, the impinging radar energy passes through oriented tubing; and the different radar-energy path-lengths may prevent the formation of the theoretical standing wave. However, the structure of FIG. 5 minimizes this problem. In this illustration, the radar energy impinges in the direction indicated by arrow 20, and passes through the structure, to be reflected by reflecting-sheet 32. Reflector-sheet 32 and and absorber-sheets 34*c*, 34*d*, 34*e*, etc. are to be spaced apart as previously described; but in the embodiment shown in FIG. 5, the outermost absorber-sheet 34*f* and the innermost reflective-sheet 32 are urged away from each other by a pressurized fluid or gas, in a manner to be discussed later. As sheets 32 and 34*f* are urged away from each other, their spacing is established by the use of substantially inextensible tension-members such as 42*c*, 42*d*, etc.

Figure 5:
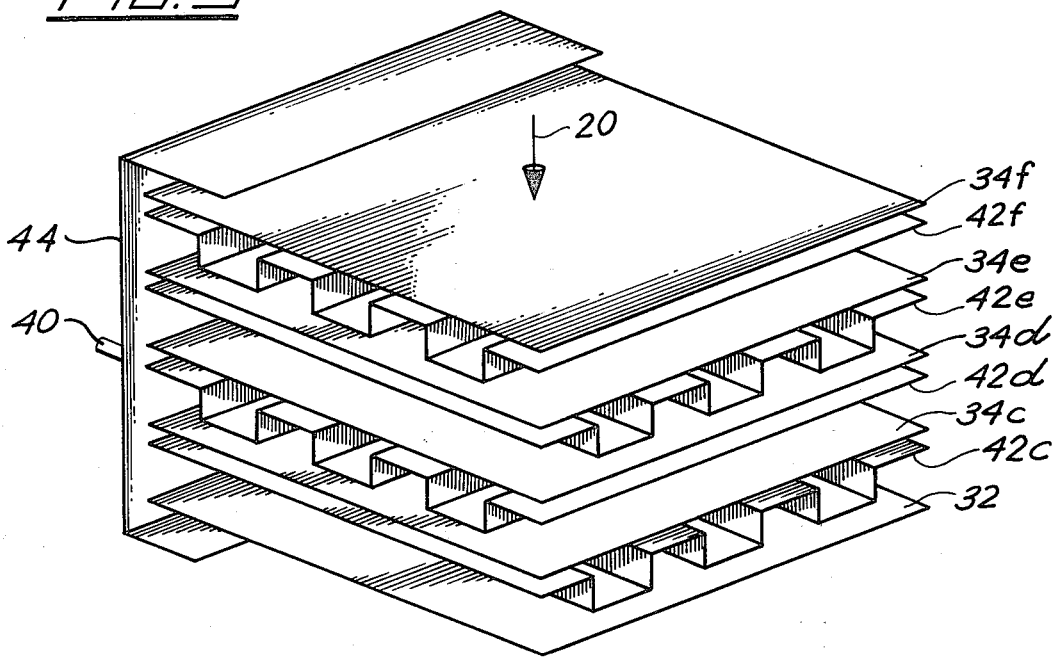
FIG. 5 illustrates a Salisbury-type screen having a different type of spacing arrangement.

As shown in FIG. 5, tension-elements 42 take the form of a material that has been folded to assume a rectangular-fret configuration; the horizontal portions of this rectangular-fret configuration being adhered, sewn, or otherwise bonded to proximal sheets. Thus, adjacent sheets such as 32 and 34*c* are properly spaced apart by the tension element 42*c* when the sheets are urged apart by the inflatable means to be described later. In a similar manner, each of the absorber-sheets 34 is spaced from its adjacent absorber-sheet by a similar rectangular-fret tension-element 42.

FIG. 5 shows tension-elements 42 to be crossed relative to adjacent tension-elements; and this is done for the following reason. If the tension-elements were all parallel to each other; some impinging radiation would find that its path consisted primarily of pressurizing fluid; while other paths would consist primarily of the vertically-alined portions of the tension members. Since the tension elements may have different electrical characteristics than the pressurizing fluid, some portions of the structure would produce a radiation-path wherein the absorber-sheets 34 were not spaced properly, from an electrical point of view; that is, they would not fall at the effective quarter-wavelength position. The arrangement shown in FIG. 5, wherein the tension-elements are angled to each other, assures that the impinging radiation will find substantially identical paths regardless of which portion of the Salisbury-type screen structure it falls upon; so that the absorber-sheets are at their design distance from the reflector-plate.

In order to inflate the structure of FIG. 5, the edges are sealed by an edge-sealing member 44 having its upper and lower portions hermetically sealed to the outermost and innermost sheets. Sealing member 44 of course extends around all edges of the structure to form a sealed structure; and an inflating valve 40 admits a pressurized fluid to the interior portion of the structure. The pressurized fluid urges the lowermost sheet 32 away from the uppermost sheet 34*f*; and this urging-apart causes the tension elements 42 to assume the configuration shown in FIG. 5. In this way, the inflated absorbing-structure causes the absorbing sheets to be properly positioned for their optimum absorption; meanwhile permitting the deflated absorbing-structure to occupy only a fraction of the room required by the inflated structure.

It should be noted that the inflated tubing discussed in connection with FIGS. 3 and 4 are also tension-elements, acting in the above-described manner; and that the embodiments of FIG. 5 et seq are of the ballon-type—in that they are inflated to assume their desired configuration.

FIG. 5 illustrates the use of four absorber-sheets 34*c*, 34*d*, 34*e*, and 34*f*; and the previously-mentioned U.S. Pat. No. 3,349,397 offers the following discussion of such absorber-sheets.

A typical absorber sheet comprises a glass fabric that has an elastomer coated thereon such a neoprene or the like, or other flexible synthetic resin. Suspended in the elastomer in the coating are particles of carbon or similar semi-conductive materials in order to obtain a selected impedance in the absorber sheet. The impedance of the absorber sheet can also be modified by the addition of metal powders such as aluminum.

In order to control the resistivity and insertion loss of the sheets, the proportion of carbon in the coating, the thickness of the coating and the type of carbon in the coating are controlled. The total weight of coating material on the fabric is preferably in excess of 1 gram per square foot of fabric since lower weights give difficulty in obtaining appreciable electrical conductivity.

Table I gives some examples of conductive sheets useful in the practice of this invention with insertion loss measured at a frequency of 9.375 gHz. Many other variations of such sheets are readily prepared. All of these sheets are prepared on a commercially designated 116 type glass cloth which is a 59×57 thread count fabric having a crowfoot satin or plain weave. The fabric is about 0.004 inch thick before coating, and in a "greige" or unfinished condition. The conductive compositions were applied by spraying, box brushing, or dip coating of the neoprene-carbon mixture in sufficient solvent of 80 parts toluene, 20 parts xylene to obtain a suitable viscosity, followed by solvent evaporation and heat curing.

TABLE I

| Insertion Loss (db) | Parts Neopene Resin | Parts Carbon | | | Coating Weight (gm./ft.$^2$) |
|---|---|---|---|---|---|
| | | Graph-ite | Acetylene Black | Furnace Black | |
| 0.6 | 100 | 51.2 | | | 8.3 |
| 1.6 | 100 | 51.2 | | | 15.0 |
| 1.9 | 100 | 51.2 | | | 17.1 |
| 2.3 | 100 | 60.5 | | | 15.4 |
| 2.9 | 100 | | | 20.5 | 7.6 |
| 3.1 | 100 | | | 20.5 | 8.1 |
| 3.3 | 100 | 60.5 | | | 27.3 |
| 4.0 | 100 | | 51.2 | | 3.7 |
| 5.4 | 100 | 80.0 | | | 17.4 |
| 7.1 | 100 | | 34.1 | | 10.3 |
| 7.3 | 100 | | 80.0 | | 6.4 |
| 7.4 | 100 | | | 23.5 | 16.5 |
| 8.0 | 100 | | 60.5 | | 10.6 |
| 8.9 | 100 | 80.0 | | | 29.2 |

As taught in the previously-mentioned patent, a plurality of absorber-sheets can be used to achieve the desired effect. For example, referring to FIG. 5, absorber-sheet 34*f* may have an insertion loss of 7.4 db; absorber-sheet 34*e* may have an insertion loss of 3.1 db, absorber-sheet 34*d* may have an insertion loss of 2.9 db; and absorber-sheet 34*c* may have an insertion loss in the range of 0.3 to 0.6 db.

If a three-layer Salisbury-type screen were used, the absorber-sheets may have insertion losses of 7.4, 2.9, and 1.9 db. Other values for different numbers of absorber-sheets may be used; these absorber-sheets being prepared as indicated in Table I.

Figure 6:
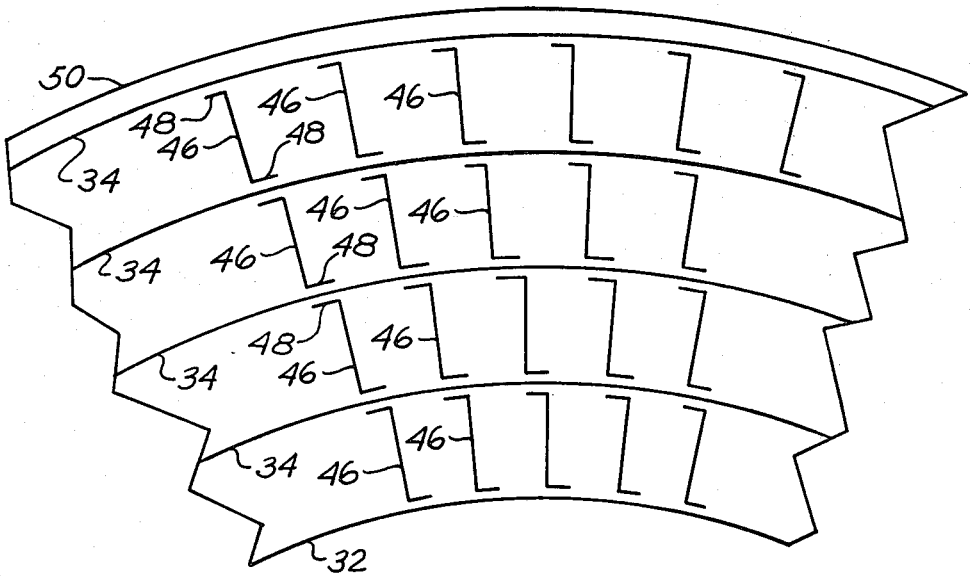
FIG. 6 illustrates a curved Salisbury-type screen.

FIG. 6 shows a partial cross sectional view of a curved (cylindrical, conical, etc.) Salisbury-type screen, having an inner-reflecting-sheet 32 and a plurality of absorbing-sheets 34. Tension-elements 46 may take the form of strips that are Z-shaped, having one edge sealed to one sheet; and having its other edge sealed to the adjacent sheet. As shown in FIG. 6, adjacent tension-elements 46 are staggered in order to provide the substantially homogeneous radiation-path discussed above; however, if desired, their sealed portions 48 may be juxtaposed in order to facilitate an adhesion, sewing, or bonding manufacturing process.

In FIG. 6, the entire structure is enclosed in an outer sheath 50 of fluid-impermeable material such as a plastic, thus forming a sealed inflatable structure; portions of this sheath being affixed in any suitable manner (not shown) to the outermost sheet 34. When this structure is inflated, it tends to balloon outwardly; so that if the innermost sheet 32 is suitably restrained by size considerations or by suitable tension elements, etc., the tension-elements 46 stretch to their utmost extent, and thus establish a fixed spacing for the various sheets of the structure.

As discussed above, the tension-elements 46 of FIG. 6 may be long, edge-fastened strips of material—these being useful for configurations such as cylinders, cones, planar structures, etc. Alternatively, however, the tension-elements 46 may take the form of short lengths of string, tape, or the like, that have their ends fixed to their adjacent sheets—these being useful for configurations such as spheres, domes, ellipses, and the like. In any case, it is preferable that the tension-elements be offset, or staggered, rather than being radially alined.

Figure 7:
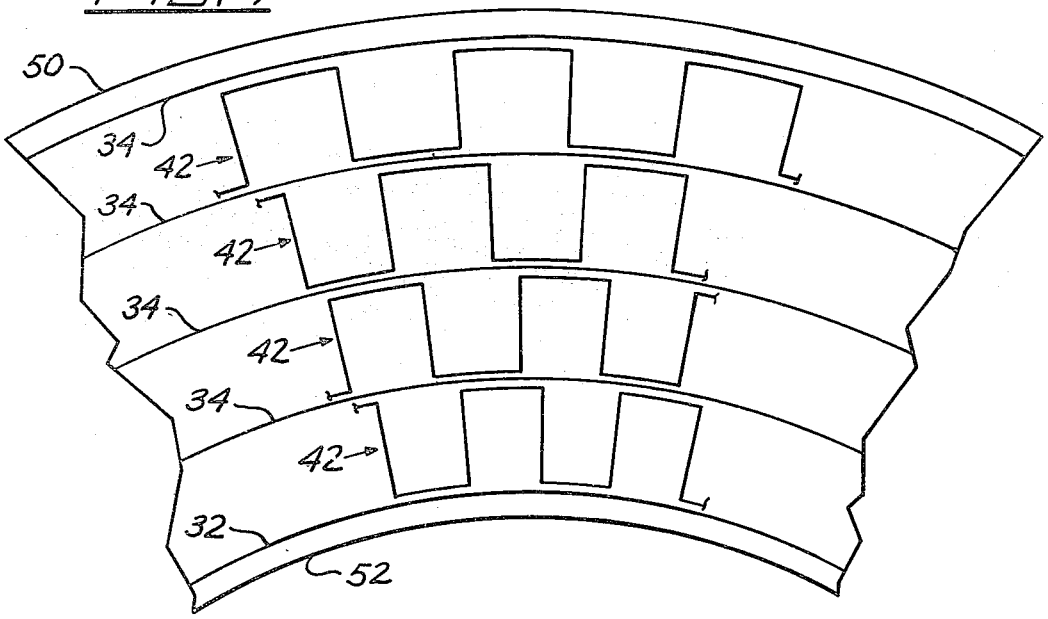
FIG. 7 illustrates another Salisbury-type screen.

FIG. 7 shows another arrangement for a curved Salisbury-type screen; this embodiment showing tension-elements 42 in the form of rectangular-frets as discussed previously, that have the "horizontal" portions affixed to proximal sheets. Here too, adjacent tension-elements are preferably staggered, angled, or offset, for reasons previously discussed. In the embodiment of FIG. 7, an additional inner sheath 52 is suitably affixed to the innermost reflective sheet 32 of the structure. In this arrangement, the volume between outer sheath 50 and inner sheath 52 is suitably sealed and pressurized or inflated; so that the structure takes the form of a collar, a toroid, a hollow sphere, etc. Here too, the pressurized volume causes outer sheath 50 and inner sheath 52 to be urged away from each other, so that tension-elements 42 assume the illustrated form. Here also, it is apparent that the deflated structure will require only a small portion of the volume needed for the inflated structure.

It should be noted that, in FIGS. 3 and 4, inflatable tubing 36 and 36*a* are also tension members—as their non-stretching characteristics and the tension produced therein is used for spacing the absorber and/or reflector sheets. Moreover, in FIG. 5, the outermost sheet and the edge-sealing member form an outer sheath; and the innermost sheet and the edge-sealing member form an inner sheath.

Figure 9:
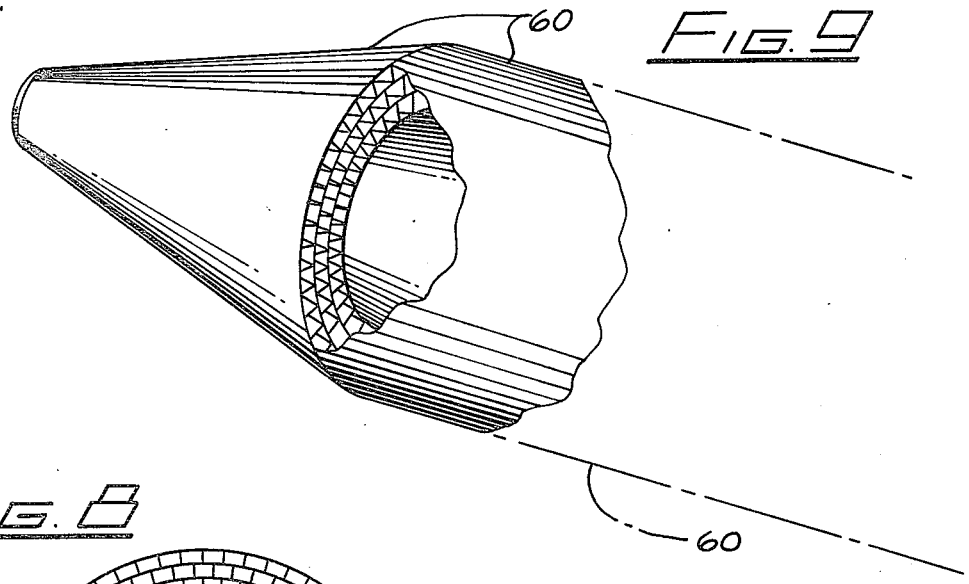
FIGS. 8 and 9 illustrate various configurations that can be formed by the use of the disclosed inflatable radar-absorbing material.
Figure 8:
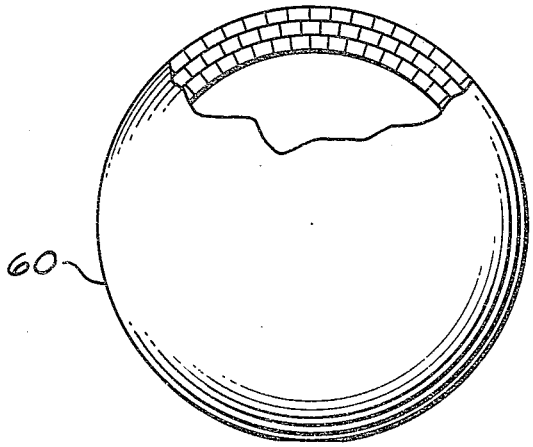

FIG. 8 depicts a sphere which may be made of the disclosed structure; and FIG. 9 shows a closed cylinder that may be formed with conical or dome-shaped end-closing members. In each case, the skin portion 60 of the body is an absorption-structure for absorbing electromagnetic radiation; this structure being preferably formed as discussed in connection with FIGS. 5, 6, and 7; and may be made inflatable and radar attenuating in the manner discussed in the above description; suitable sheath and tension-elements being used to provide the desired spacing between the various absorber-sheets and the reflector-sheet.

Depending upon requirements, the internal volume may be pressurized in order to achieve inflation; or, in those cases where a non-pressurized internal volume is desired, inner and outer skins may be used to provide a balloon-like configuration. Thus, the disclosed structures form a sealed, inflatable, self-supporting structure for absorbing electromagnetic radiation.

Although the invention has been described and illustrated in detail, it is to be clearly understood that the same is by way of illustration and example only, and is not to be taken by way of limitation; the spirit and scope of this invention being limited only by the terms of the appended claims.

What is claimed is:

1. An absorption-structure for absorbing electromagnetic radiation, comprising:

means, comprising a sheet of radiation-reflecting material, for reflecting impinging electromagnetic radiation;

means, comprising at least one sheet of radiation-absorbing material, for absorbing said electromagnetic radiation; and inflatable means for suitably positioning said absorbing-means relative to said reflecting means for optimizing the absorption of said electromagnetic radiation.

2. The combination of claim 1 wherein said inflatable means comprises inflatable tubing, positioned between adjacent sheets, for spacing apart said sheets.

3. The combination of claim 1 wherein said inflatable means comprises an air-mattress type of structure.

4. The combination of claim 1 wherein said inflatable means comprise balloon type means for spacing apart said sheets.

5. The combination of claim 1 wherein said inflatable means comprises tension means, affixed to adjacent sheets, for spacing said sheets for optimum absorption.

6. The combination of claim 1 wherein said absorbing means comprises a plurality of absorbing-sheets, and wherein said inflatable means suitably positions all said absorbing means relative to said reflecting means to optimize the absorption of said electromagnetic radiation.

7. The combination of claim 6 wherein said absorbing-sheets have insertion-losses of about 7.4, 3.1, 2.9, and 0.4 db.

8. The combination of claim 6 wherein said inflatable means comprises tension means, affixed to adjacent sheets, for spacing said plurality of sheets for optimum absorption.

9. The combination of claim 8 wherein said tension means are staggered.

10. The combination of claim 8 wherein said tension means are angled.

11. The combination of claim 6 wherein said absorbing-structure comprises a pressurable outer sheath—whereby the volume within said outer sheath may be pressurized.

12. The combination of claim 6 wherein said absorbing-structure comprises a pressurizable outer sheath and a pressurizable inner sheath—whereby the volume between said sheaths may be pressurized.

13. A Salisbury-type screen for absorbing electromagnetic radiation, comprising:

means, comprising a sheet of radiation-reflecting material, for reflecting impinging electromagnetic radiation;

means, comprising a plurality of sheets of radiation-absorbing material, for absorbing electromagnetic radiation;

means, comprising tension-elements positioned between—and affixed to—adjacent sheets for spacing said sheets to achieve optimum radiation absorption; and inflating means for urging apart said sheets of said screen to limits established by said tension-elements.

14. The combination of claim 13 wherein said tension-elements comprise rectangular-fret configurations that are angled relative to each other.

15. The combination of claim 13 wherein said tension-elements comprise rectangular configurations that are parallel to each other.

16. The combination of claim 13 wherein said tension-elements comprise configurations that are staggered to each other.

17. The combination of claim 12 wherein said tension-elements comprise a strip-like configuration having their edges affixed to proximal sheets.

18. The combination of claim 12 wherein said tension-elements comprise strips having their ends affixed to proximal sheets.

19. The combination of claim 13 including:

an outer sheath affixed to the outermost of said sheets;

an inner sheath affixed to the innermost of said sheets; and means for causing said inflating means to urge apart said sheaths.

20. An absorption structure for absorbing electromagnetic radiation, comprising:

means, comprising at least one sheet of radiation absorbing material, for absorbing said electromagnetic radiation; and inflatable means for suitably positioning said absorbing means for optimising the absorption of said electromagnetic radiation.

* * * * *